US005132141A

United States Patent [19]

Schön

[11] Patent Number: 5,132,141

[45] Date of Patent: Jul. 21, 1992

[54] METHOD FOR THE MANUFACTURE OF LIQUID-IMPERMEABLE, FLEXIBLE BANDS

[75] Inventor: Werner Schön, Heidenheim, Fed. Rep. of Germany

[73] Assignee: F. Oberdorfer GmbH & Co. KG Industriegewebe-Technik, Fed. Rep. of Germany

[21] Appl. No.: 556,334

[22] Filed: Jul. 20, 1990

[30] Foreign Application Priority Data

Sep. 7, 1989 [DE] Fed. Rep. of Germany ..... 3929820

[51] Int. Cl.[5] ..... B05D 3/12

[52] U.S. Cl. ..... 427/171; 427/389.8; 156/137; 156/242

[58] Field of Search ..... 427/389.9, 389.8, 171; 162/358, DIG. 1; 428/255, 247, 423.1; 156/137, 242

[56] References Cited

U.S. PATENT DOCUMENTS

| | | | |
|---|---|---|---|
| 3,592,709 | 7/1971 | Marzocchi et al. | 156/137 X |
| 3,673,024 | 6/1972 | Eriksson | 156/137 |
| 4,018,641 | 4/1977 | Donaldson | 156/137 |
| 4,288,475 | 9/1981 | Meeker | 427/389.8 X |
| 4,552,620 | 11/1985 | Adams | 428/311.1 X |
| 4,787,946 | 11/1988 | Romanski | 156/137 |
| 4,981,721 | 1/1991 | Krenkel et al. | 427/276 X |

*Primary Examiner*—Michael Lusignan
*Assistant Examiner*—Alain Bashore
*Attorney, Agent, or Firm*—Gifford, Groh, Sprinkle, Patmore and Anderson

[57] ABSTRACT

The invention relates to a method for the manufacture of impermeable, flexible, elastical bands having a smooth inner surface and consisting of a plastic fabric, including spiral bands and mats of threads, which bands are especially suited for use in connection with an extended nip of wet presses of paper making machines. These bands are used as press bands or press coates and are manufactured by applying a mixture of a prepolymer, especially polyurethane, in a flowable consistence to an endless fabric band and joining that mixture thereto, which band is transported over a reverting roll device and is coated by means of at least one nozzle on its outer surface with the flowable prepolymer mixture. In order to improve the known method which is provided with drawbacks the invention proposes to spread over the at least parallel and distantly arranged rolls of the roll device an elastic carrier band having a smooth upper surface onto which the fabric band which is to be coated is tensioned in such a way that during the coating of the fabric band with the flowable prepolymer mixture the two bands cannot slip with respect to one another.

10 Claims, 1 Drawing Sheet

METHOD FOR THE MANUFACTURE OF LIQUID-IMPERMEABLE, FLEXIBLE BANDS

BACKGROUND OF THE INVENTION

The invention relates to a method for the manufacture of liquid-impermeable, flexible, elastical bands having a smooth inner surface and consisting of plastic fabrics. These press bands should also include spiral bands and bands of threads or yarns and are particularly suited for press bands and press belts for wet presses of paper making machines provided with an extended press nip. In order to manufacture these press bands or press coats a free flowing mixture of a prepolymer, especially polyurethane, is poured onto an endless web band and thereby joint thereto, which endless web band or fabric band is guided over a roll equipment provided with at least two distantly arranged rolls turning back the web band, the surface of said band is simultaneously coated on its outer surface by at least one nozzle with said free flowing prepolymer mixture. According to the German published application (DE-OS No. 3,801,850) a reinforcing fabric band is guided over a roll equipment turning that band back and consisting of two distantly and parallel arranged rolls so that the band is coated on its outer surface or its inner surface with a flowable prepolymer mixture. During said coating process the flowable mass runs to the surface of the roll which may be provided with a separating agent, especially silicone oil in order to support separation of the coated inner surface of the reinforcing fabric band from the surface of the roll. Such a procedure, however, is because of the necessary coating of the roll in order to avoid adherence of the cured polymer on the surface of the rolls cost intensive and results in many cases besides of the above-mentioned measure therein that the inner surface, i.e. the flat surface of the reinforcing band opposite to the surface of the rolls and contacting them, which is coated in such a way, is not provided with a homogenious coating.

SUMMARY OF THE PRESENT INVENTION

It is therefore an object of the invention to promote the known method in such a way that the above-mentioned drawbacks are avoided.

It is a further object of the invention to promote the known method in such a way that the finished coated fabric band is provided with a smooth, clean, uniformly coated inner surface which need not be treated further.

According to still a further object of the invention the method of the known kind should be developed such that it is possible to manufacture so-called "hard" bands.

These and other objects are accomplished by extending over the roll equipment consisting of at least two parallel rolls an elastic carrier band provided with a smooth upper surface on which the fabric band which is to be coated is put up such that during the coating of the fabric band with the free flowing prepolymer mixture sliding of the two bands with respect to one another is excluded.

It has been found especially advantageous if the fabric web is spread over the smooth upper surface of the carrier band such that the fabric band contacts the upper surface only by its knuckles.

According to another advantageous embodiment of the subject invention the prepolymer mixture is applied to the fabric band to be coated in such a way that its pores or meshes are penetrated by the coating material contacting the smooth upper surface of the carrier band and covering essentially in an uniform manner the surface of the fabric band opposite to said smooth surface of the carrier band, whereafter the penetrated material is cured.

Finally, according to a further advantageous embodiment of the subject invention the thickness of the coating on the surface of the carrier band and consisting of the prepolymer mixture can be adjusted by changing the tension of the fabric band.

BRIEF DESCRIPTION OF THE DRAWING

The invention will be described below with reference to the embodiment thereof as illustrated in the drawing showing an apparatus for the manufacture of press bands.

DETAILED DESCRIPTION OF THE PRESENT INVENTION

Figure 1:
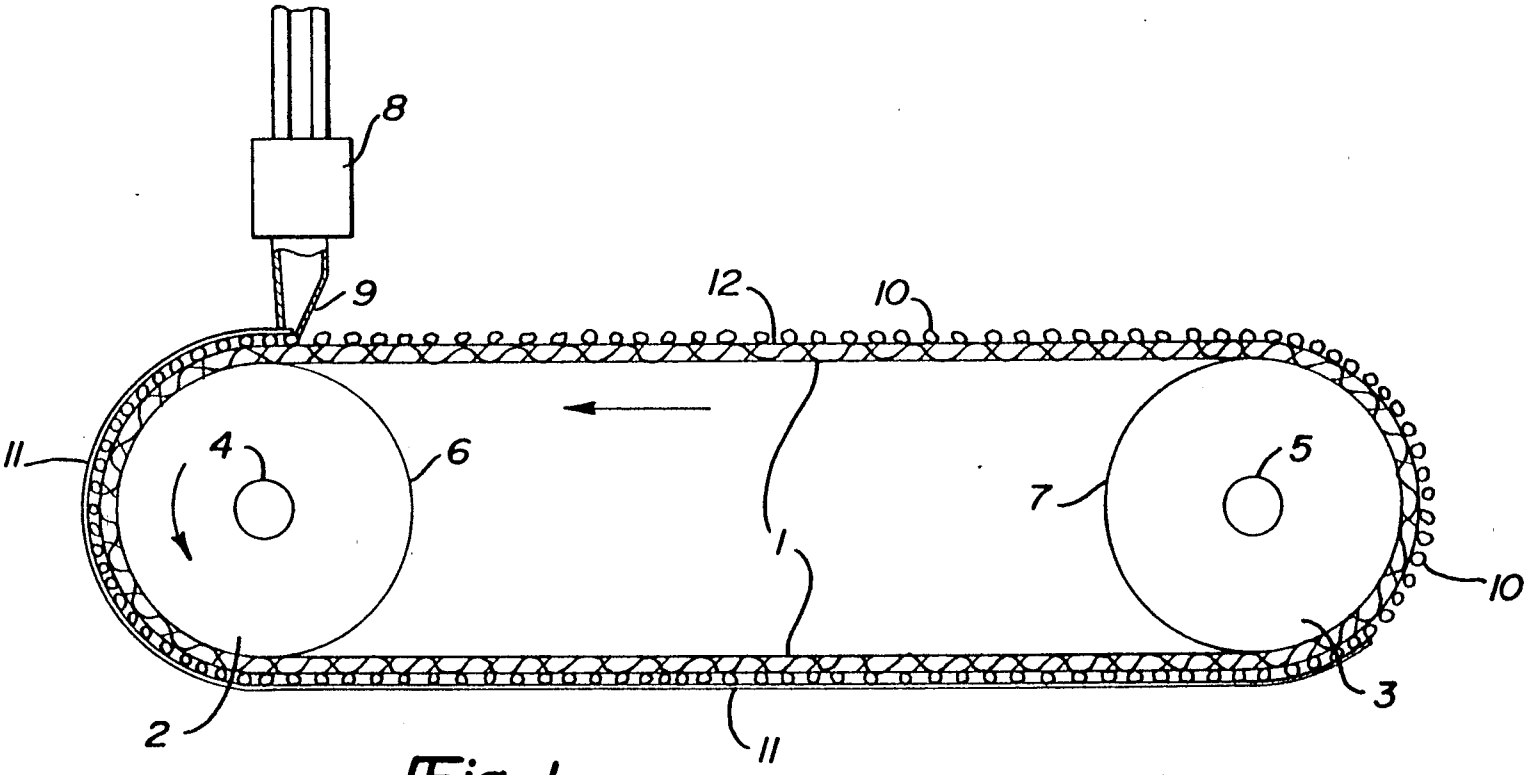

Over the surfaces 6 and 7 of the two distantly arranged parallel rolls 2, 3 mounted on the axes 4 and 5 an elastic band 1 as carrier band is drawn having a smooth upper side 12 and running as an endless band over the surfaces of the rolls at least one of which is driven by a motor. The tension of that carrier band may be adjusted by adjusting the two axes 4, 5 of the rolls with respect to one another. Onto the carrier band 1 the fabric band 10 is put which is to be coated and is also tensioned so that between the carrier band and the fabric band no relative movement can occur, when both the bands run in that superposition in the direction of the arrow over the roll surfaces. During that movement the coated fabric band in general contacts the smooth upper side of the carrier band only by its knuckles.

Onto the outer surface of the fabric band a flowable prepolymer mixture is applied to a mixing head 8 and a mixing nozzle 9 in a required thickness 11, so that the pores or meshes of the fabric band are penetrated by the coating material which passes onto the smooth upper surface 12 of the carrier band 1 and covers the upper surface of the opposite area of the fabric band completely and in an essential homogenious manner. Thus, the coating material is also passing below the knuckles of the fabric band, before it cures.

The thickness of the coating on the carrier band consisting of coating material may be changed by adjusting the tension of the fabric band within certain limits. Such change of tension is caused in this connection by adjusting the two rolls 2, 3 with respect to another. It goes without saying that the mass of the coating material penetrating the meshes or pores of the fabric band also depends on the viscosity of the material and may therefore be controlled in certain limits by adjusting the viscosity.

The thickness 11 of the coating i.e. the height of the coating mass on the fabric band can also be adjusted in a known manner so that after cooling and curing of the coating material the upper surface of the fabric band may be treated mechanically in order to get the required structure, for instance grooves and bores, whereas the inner surface of the fabric band must not be treated, because it is smooth and corresponds with respect to its character completely to the presses. Thus, the finished and coated fabric band must not be reverted or turned over so that the above-mentioned method enables the manufacture of "hard" bands, i.e. bands turning of which have been very difficult in the past or have been completely impossible.

We claim:

1. A method of manufacturing liquid impermeable, flexible, elastic press bands having a smooth inner surface consisting of plastic fabric, including spiral bans and mats of threads, especially for use in connection with wet presses of paper making machines, said method comprising the steps of:

applying a fabric band onto an elastic carrier band;

transporting said fabric band and said elastic carrier band over a roll device;

tensioning said fabric band by said roll device so as to prevent slippage of said fabric band with respect to said elastic carrier band;

pouring a flowable mixture of a prepolymer onto said fabric band, said flowable mixture permeating said fabric band.

2. The method according to claim 1, wherein said step of tensioning said fabric band is done so that said fabric band is contacting a smooth upper surface of said elastic carrier band only by its knuckles.

3. The method according to claim 1, wherein said step of pouring said prepolymer mixture is applied to said fabric band in such a way that its pores or meshes are penetrated by said prepolymer mixture, said prepolymer mixture passes onto a smooth upper surface of said elastic carrier band and covers that surface of said fabric band opposite said upper surface completely and in an essentially homogeneous manner.

4. The method according to claim 2, wherein during said step of pouring said prepolymer mixture onto said fabric band its pores or meshes are penetrated by said prepolymer mixture and said prepolymer mixture passes onto a smooth upper surface of said elastic carrier band and covers the surface of said fabric band opposite said upper surface completely and in an essentially homogenous manner.

5. The method according to claim 1, wherein said step of tensioning said fabric band adjusts the thickness of said prepolymer mixture on said elastic carrier band, and the changing of said tension on said fabric band is accomplished by said roll device.

6. The method according to claim 2, wherein said step of tensioning said fabric band adjusts the thickness of said prepolymer mixture on said elastic carrier band, and the changing of said tension of said fabric band is accomplished by said roll device.

7. The method according to claim 3, wherein said step of tensioning said fabric band adjusts the thickness of said prepolymer mixture on said elastic carrier band, and the changing of said tension of said fabric band is accomplished by said roll device.

8. The method according to claim 1 wherein said step of pouring a flowable mixture of a prepolymer comprises pouring polyurethane.

9. The method according to claim 3, further including the step of curing said prepolymer mixture.

10. The method according to claim 4, further including the step of curing said prepolymer mixture.

* * * * *